US006257664B1

(12) United States Patent
Chew et al.

(10) Patent No.: US 6,257,664 B1
(45) Date of Patent: Jul. 10, 2001

(54) MULTIPLE ADJUSTABLE BACK ASSEMBLY FOR USE WITH WHEELCHAIR

(75) Inventors: Norman Chew, Toronto; Nenad Medjedovic, Aurora, both of (CA)

(73) Assignee: Invacare Corporation, Elyria, OH (US)

( * ) Notice: Subject to any disclaimer, the term of this patent is extended or adjusted under 35 U.S.C. 154(b) by 0 days.

(21) Appl. No.: 09/438,755

(22) Filed: Nov. 11, 1999

Related U.S. Application Data

(60) Provisional application No. 60/108,609, filed on Nov. 16, 1998.

(51) Int. Cl.[7] ..... A47C 7/14

(52) U.S. Cl. ..... 297/284.9; 297/354.12; 297/DIG. 4; 297/354.1

(58) Field of Search ..... 297/284.9, 354.12, 297/354.1, DIG. 4

(56) References Cited

U.S. PATENT DOCUMENTS

| | | | | |
|---|---|---|---|---|
| 4,647,066 | | 3/1987 | Walton | 297/DIG. 4 X |
| 5,062,677 | | 11/1991 | Jay et al. | 297/DIG. 4 X |
| 5,211,446 | | 5/1993 | Jay et al. | 297/DIG. 4 X |
| 5,228,747 | | 7/1993 | Greene | 297/DIG. 4 X |
| 5,364,162 | | 11/1994 | Bar et al. | 297/DIG. 4 X |
| 5,551,756 | | 9/1996 | Gurasich et al. | 297/554.12 X |
| 5,556,168 | | 9/1996 | Dinsmoor, III et al. | 297/DIG. 4 X |
| 5,593,211 | | 1/1997 | Jay et al. | 297/354.12 X |
| 5,647,637 | | 7/1997 | Jay et al. | 297/354.12 |
| 5,848,824 | * | 12/1998 | Mocur | 297/354.12 X |
| 5,865,504 | * | 2/1999 | Warhaftig | 297/354.12 |
| 5,944,385 | * | 8/1999 | Pearce | 297/354.12 |
| 6,048,031 | * | 4/2000 | Warhaftig | 297/354.12 |

* cited by examiner

*Primary Examiner*—Peter M. Cuomo
*Assistant Examiner*—Rodney B. White
(74) *Attorney, Agent, or Firm*—Hudak & Shunk Co., L.P.A.; Laura F. Shunk

(57) ABSTRACT

A wheelchair back assembly is mounted from the vertical post of a wheelchair. The assembly has a back member comprising one or more rigid shells which are mounted by laterally extending adjustable clamping members. These clamping members permit a variety of adjustment angles, height and depth. Further, lateral support members can be independently adjusted to accommodate a particular user.

23 Claims, 5 Drawing Sheets

MULTIPLE ADJUSTABLE BACK ASSEMBLY FOR USE WITH WHEELCHAIR

CROSS REFERENCE

This Patent Application is Based Upon U.S. Provisional Application Ser. No. 60/108,609, filed Nov. 16, 1998.

FIELD OF THE INVENTION

The invention relates generally to adjustable seat backs, and more specifically to a seat back assembly which will accommodate a variety of wheelchair and user widths, and which is easily and simply adjusted with respect to a number of aspects including, for example, the angle of the back relative to the horizontal, and the distance in and out, and up and down of the back relative to the seat and the distance up and down and in and out relative to the seat. Further, the assembly includes lateral support members, which can be independently adjusted on either side in and out to accommodate the needs of a particular user.

BACKGROUND OF THE INVENTION

Wheelchairs are available in a variety of widths, generally intended to accommodate a variety of users depending both on the user's size, as well as on the manner in which the wheelchair is used. The needs of someone permanently confined to a wheelchair differ greatly from someone who is using a wheelchair during rehabilitation or recuperation. For example, healthy but impaired people may prefer to have a sports model of a chair with a tighter seating fit. in accordance with the prior art, issues of fit have been complicated by the fact that the wheelchair base, including the seat base and vertical post width come in standard incremental sizes. Accordingly, despite complex inventory issues, wheelchair backs have been provided in incremental sizes intended to accommodate the nearest incremental size chair base. The present invention answers the deficiencies of this system by providing a back, which has incrementally or infinitely adjustability to accommodate a range of standard size chairs and provide for the specific requirements of a variety of users.

As a further aspect of the invention, the back assembly provides multiple options with respect to the adjustability relative to the seat and yet which is easily installed and used. Thus, the back assembly mounts on the vertical post or cane of a wheelchair and can be adjusted up and down, in and out, and at various angles relative to the seat.

Finally, as a separate aspect of the invention, a back assembly system is provided which allows for a variety of support functions including separately from thoracic support, sacral support, support for the lateral regions of the shoulders, and head support. Means are provided to give adjustable lateral support, which can be varied independently one side of the other, and also according to the angle of the desired support. Thus, in accordance with the invention, a back assembly is provided which generally comprises a base member, mounting hardware, and optionally one or more lateral stabilizers. The base member consists of one or more rigid shells covered with a compressible foam. In the event that multiple shells are used, connecting means are used such as a locking hinge. The mounting hardware includes a first transverse member, which can be adjusted relative to the shell to accommodate varying widths of wheelchair frames. A second member can be adjusted in and out in depth. A pin is attached to the second member and allows the assembly to be pivoted around a transverse axle relative to the clamp in order to provide for a variety of angles of the back. Clamping members are releasably secured to the pin. Finally, the first and second members includes means to provide for incremental adjustment such as for example mating arm members which can have a scalloped camming surface so as to slide into incremental positions of adjustment. In an alternative embodiment, the second member has a sliding connection relative to the first member which may, for example, be provided by a keyway?? or dovetail which allows for longitudinal adjustment while retaining a connection between the members.

The back member comprises at least one rigid shell which would constitute a thoracic support but can optionally include additional shells such as a single sacral support, or double lateral sacral supports, corresponding single or double shoulder supports, and a head rest portion. The components may be jointed using a locking hinge, which is easily adjusted into a locked position. The back member is covered with a compressible foam and an outer covering.

Lateral support members (which may be shallow or deep) are provided which can be adjusted in and out and at various angles relative to the back member. A foam covering system is provided which accommodates adjustment of the lateral members relative to the back.

DETAILED DESCRIPTION OF THE INVENTION

Figure 1:
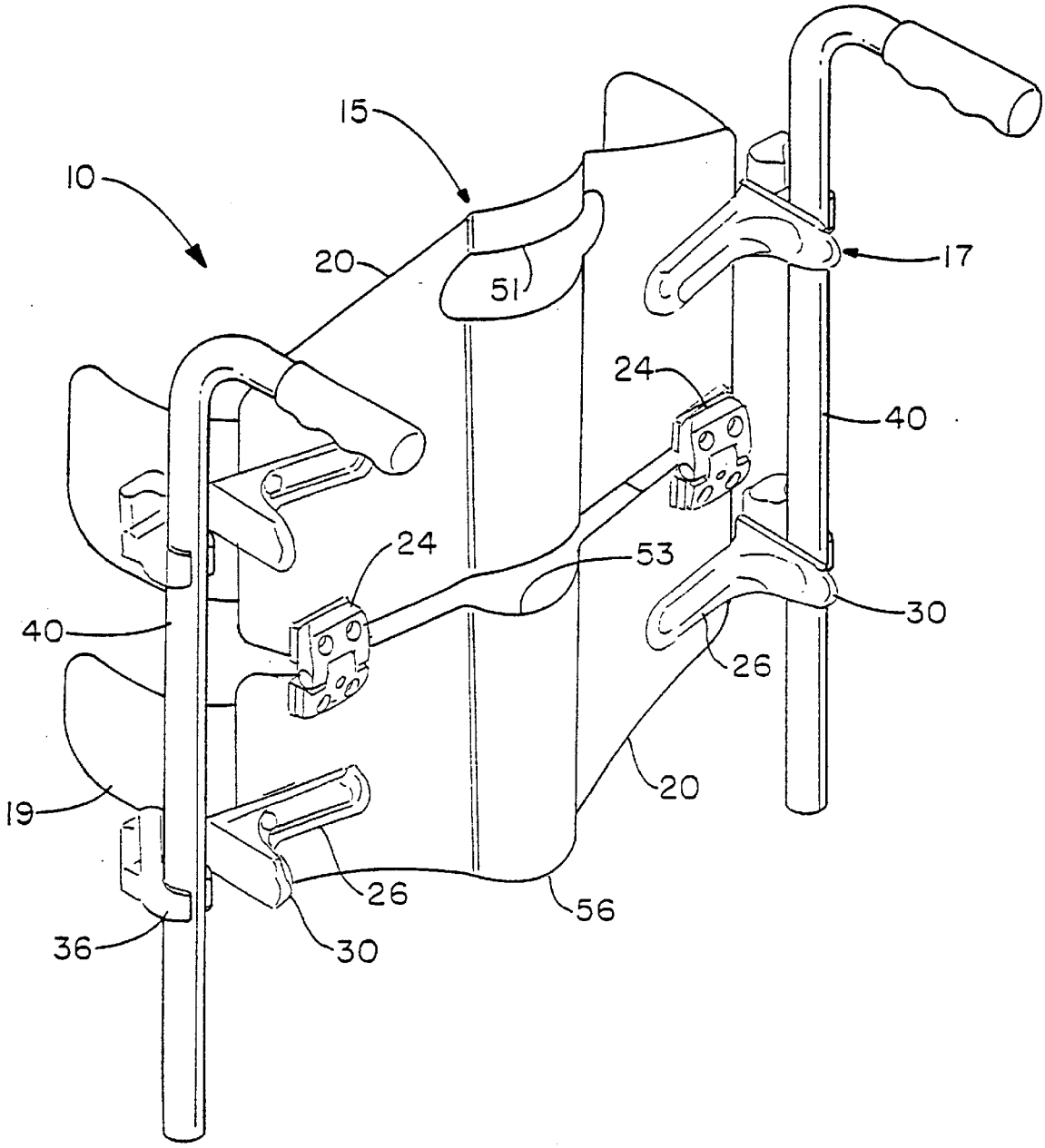
FIG. 1 is a back perspective view of a wheelchair back assembly in accordance with the present invention in position on the canes of a wheelchair.
Figure 2:
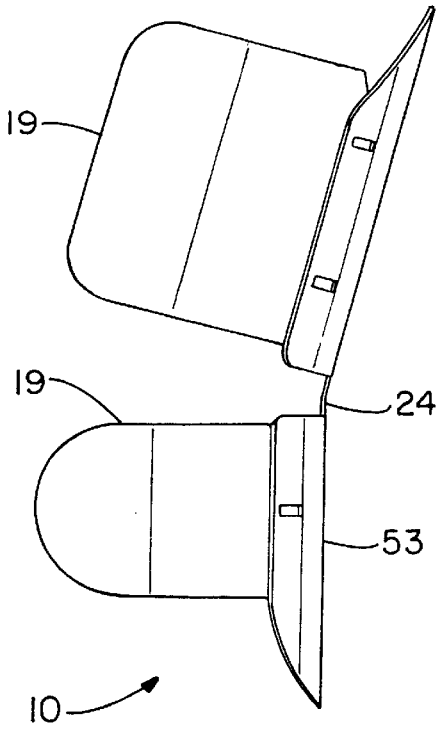
FIG. 2 is a side-plan view of a two-panel back support having lateral stabilizers.
Figure 4:
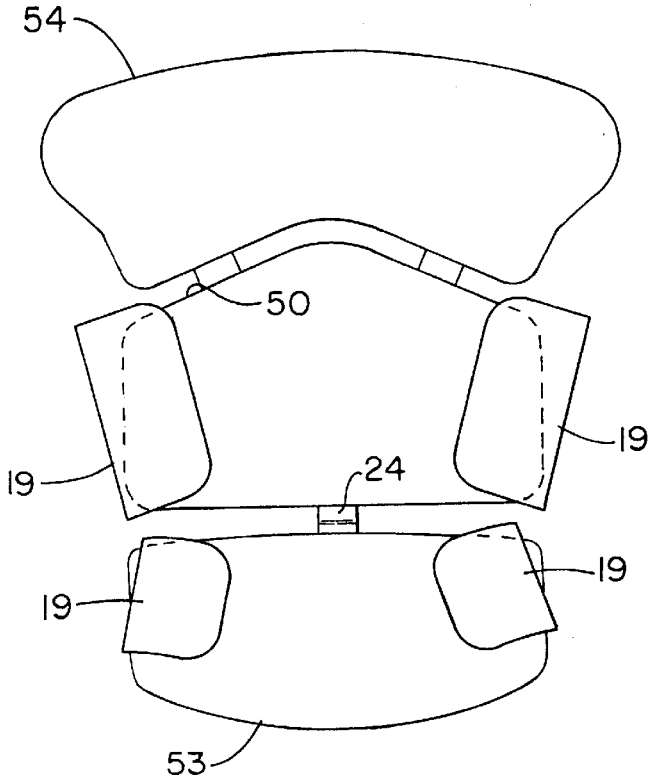
FIG. 4 is a front-plant view of a three-panel back support having lateral supports.
Figure 3:
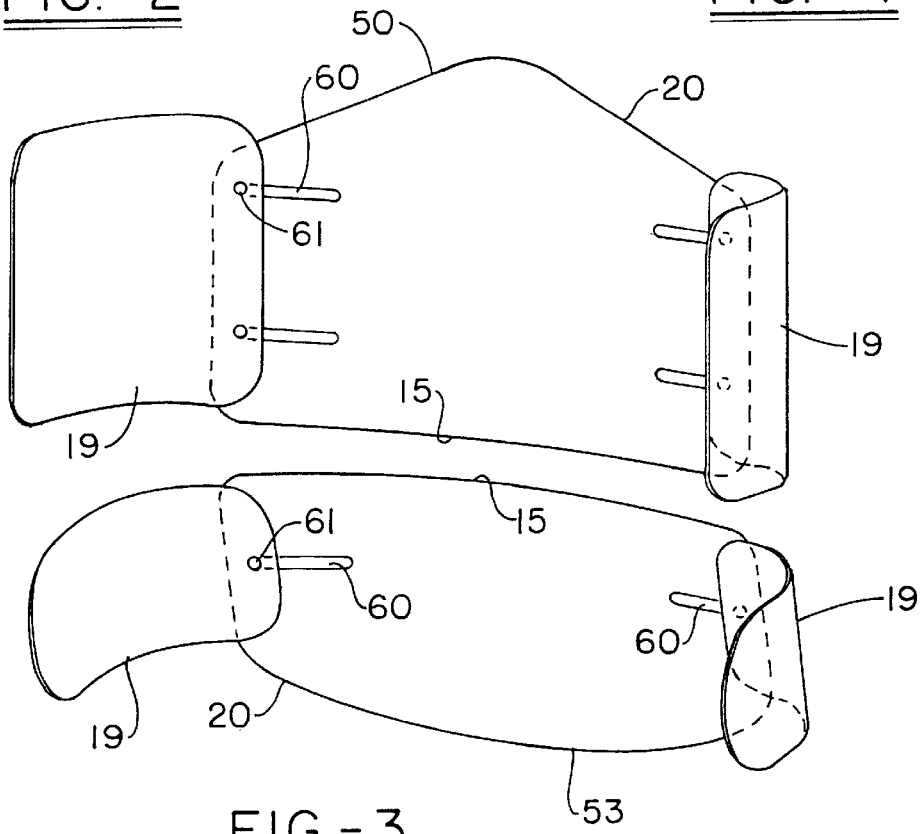
FIG. 3 is a front perspective plan of the two-panel back support of FIG. 2.
Figure 5:
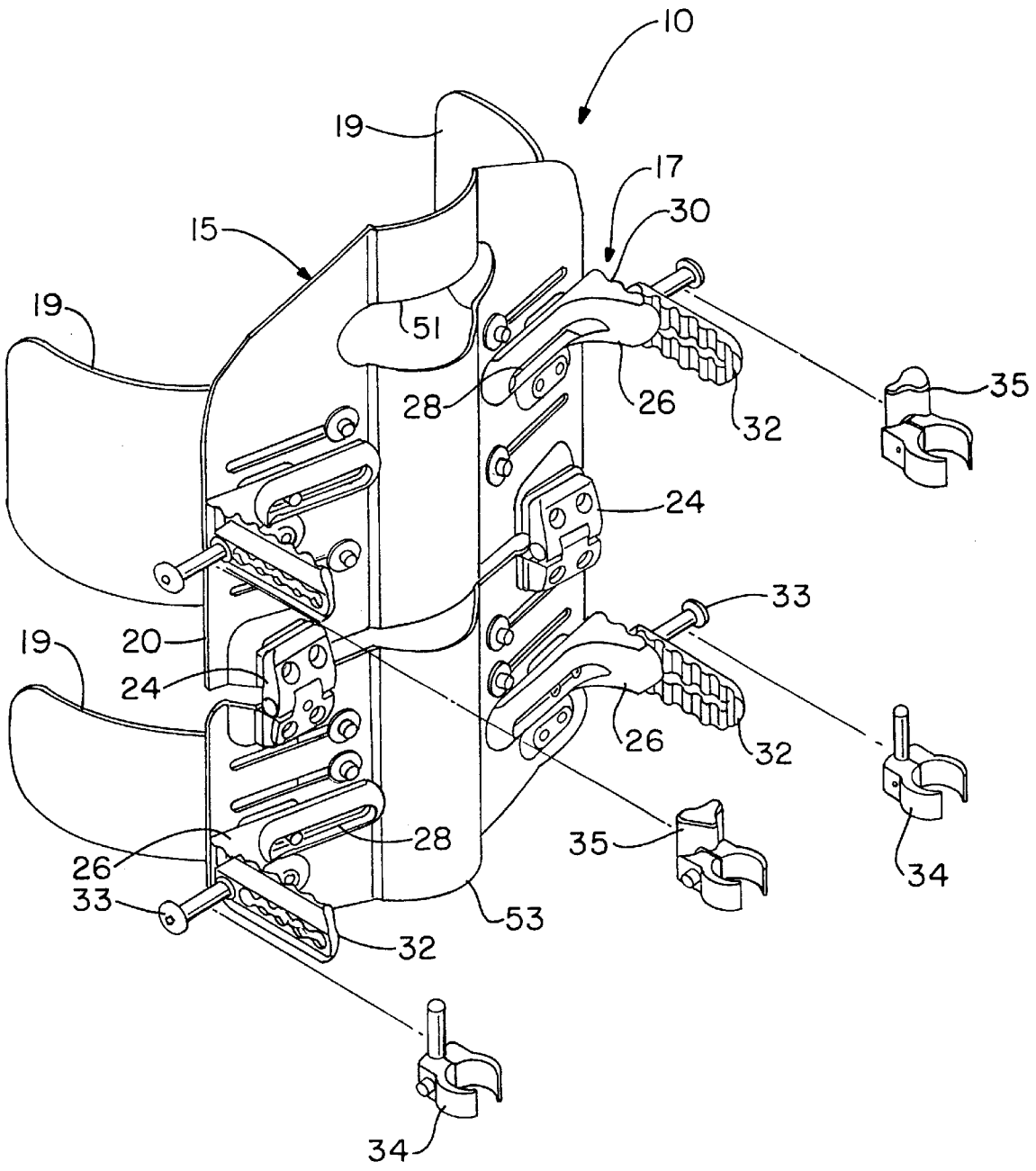
FIG. 5 is a back perspective view of the back support assembly showing an alternative embodiment of the mounting hardware.
Figure 7:
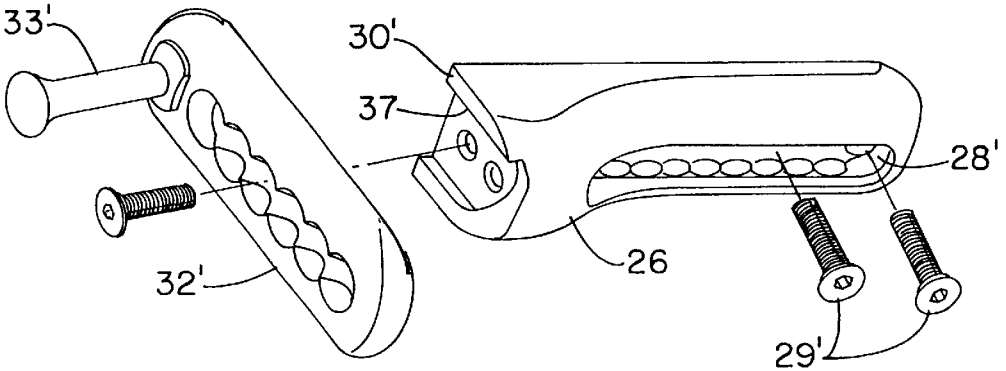
FIG. 7 is an exploded assembly drawing of the first embodiment of the mounting hardware.
Figure 8:
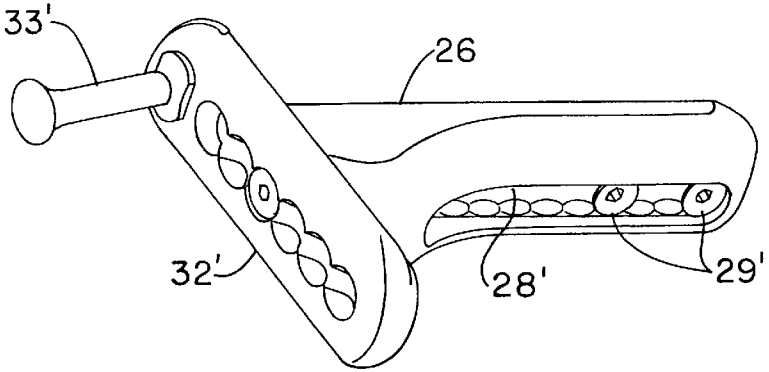
FIG. 8 is an assembled drawing of the mounting hardware showing FIG. 7.
Figure 6:
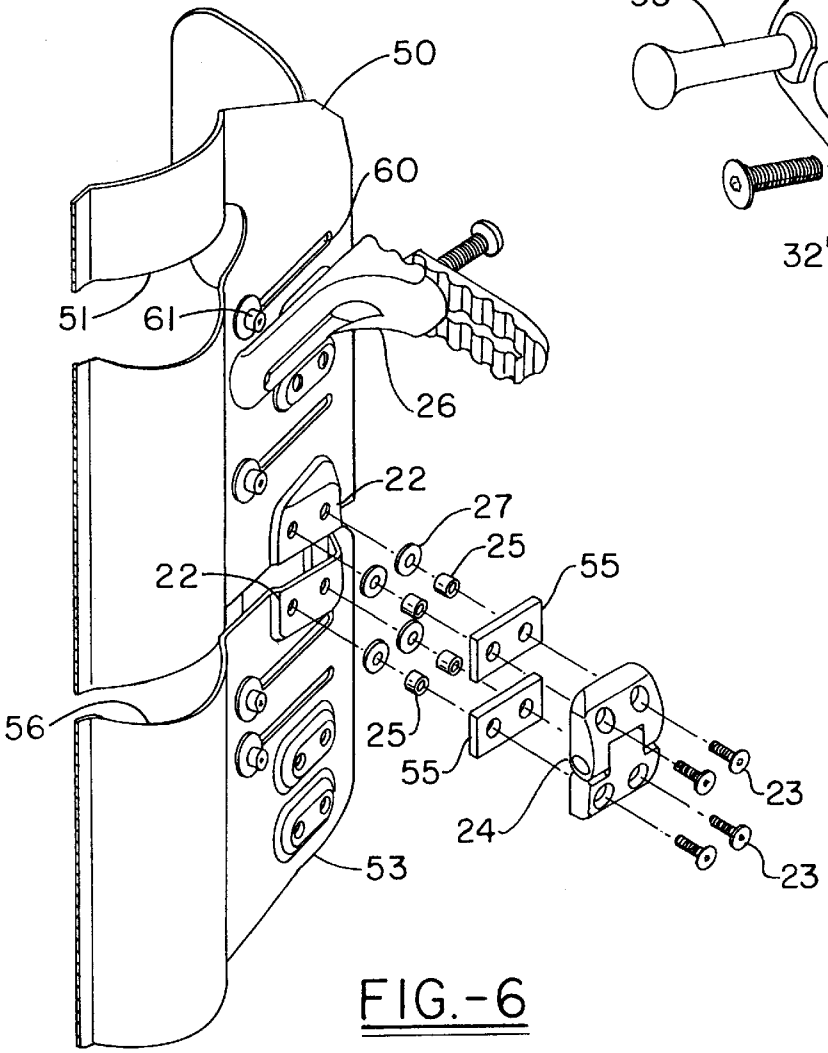
FIG. 6 is a back perspective view of the back support assembly illustrating the components of the hinge.
Figure 10:
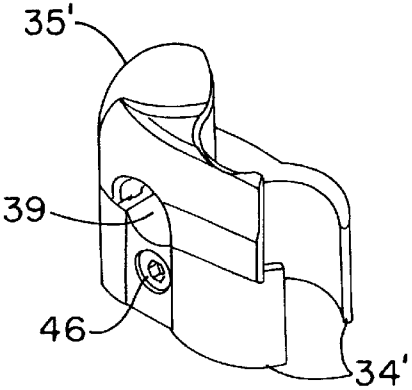
FIG. 10 is an assembled view of the cane clamp of FIG. 9.
Figure 12:
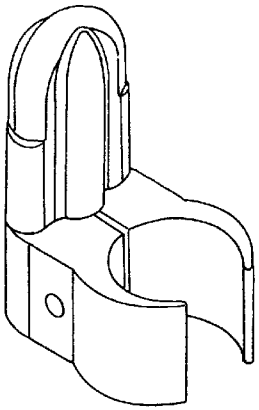
FIG. 12 is an assembled drawing of the lower cane clamp of FIG. 12.
Figure 11:
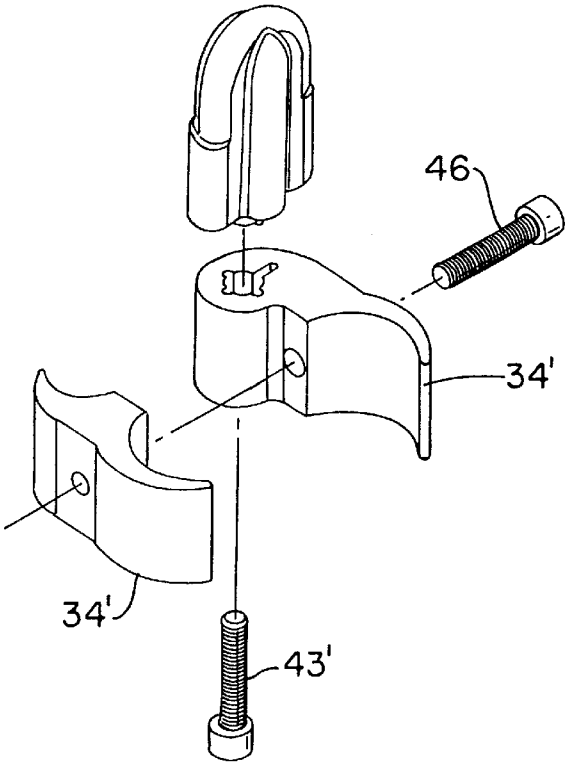
FIG. 11 is an exploded assembly drawing of an alternative embodiment of the lower cane clamp.
Figure 9:
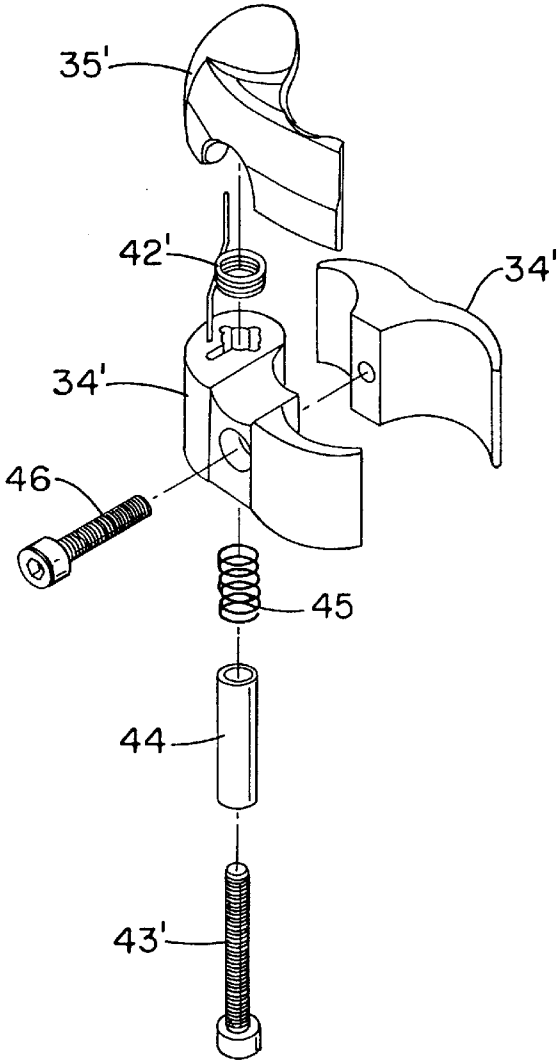
FIG. 9 is an exploded assembly drawing of an alternative embodiment of the upper cane clamp.

In accordance with the invention, a back assembly 10 is provided which generally comprises a base member 15, mounting hardware 17, and optionally one or more lateral stabilizers 19. The base member 15 consists of one or more rigid shells 20 ultimately covered with a compressible foam. By "rigid" it is generally meant that the shell is able to support the load applied by a flaccid adult body and is generally not compressible. A suitable material is ⅛–½ inch compression molded polyvinyl chloride or metal such as aluminum. A locking hinge 24 can be used. Such a hinge provides that the angle between shells can be adjusted and subsequently locked.

In the event that multiple shells are used, connecting means are used such as a locking hinge 24. The hinge assembly fits into a mounting boss 22 and locks by means of screws 23 threaded through spaces 25 into lock washers 27. The hinge can be locked in any position within a certain range. Further optional rubber disc spacers 55 allow the assembly to dynamically flex in response to lower levels of loading by the user such as would occur during normal use. The mounting hardware assembly 17 includes a first transverse member 26, which can be adjusted relative to the base to accommodate varying widths. One method of accomplishing this is a slotted connection 28 accommodating a fastener 29 secured to the shell 20. The member 26 includes a transverse arm 30. A second mounting member 32 mates with the arm 30 to enable adjustment in and out. A pin 33 is secured to the member 32 to allow the assembly to pivot around a transverse axle relative to a clamp 34 secured to the vertical post. This provides for a variety of angles of the back assembly. The second mounting member 32 can be attached to a receiver 39 formed in a C-shaped split halved clamping member 34. A spring 42 is fixed to a release tab 35. A fastener 43 is received in a sleeve 44 which supports a spring 45 and ultimately is captured in the release tab 35. A transverse fastener 46 holds the two halves of the clamp together alternatively, the first and second mounting members may include a sliding connection such as is achieved by a dovetail engagement 37. The first and second mounting member includes means to provide for incremental adjustment between them such as for example these mating arm members which have corresponding scalloped camming surfaces 36 so as to slide into incremental positions of adjustment. The clamping members 34 fasten to the vertical posts 40 of a wheelchair. Other attachment means could be used which would include other fasteners.

The back member 15 comprises at least one rigid shell 20 comprises a thoracic support 50 optionally having a hand hole 51, but can optionally include a single lumbar sacral support 53, or double lateral supports, corresponding single or double shoulder supports 54, and a head rest portion. The shells 20 preferably include a spinal channel 56 which allows for extra cushioning for vertical protrusions. The components may be jointed using a locking hinge, which is easily adjusted into a locked position. The back member is covered with a compressible foam and an outer covering.

Lateral support members 19 are provided which can be adjusted in and out and at various angles relative to the back member. Preferably each shell member 20 has two lateral support members 19. These include mounting slots 60 with a pin 61 connection to the shell which permits adjustment of the angle relative to the direction of the posts 40 and which allows positioning in and out to make the seating space wider or more narrow. A foam covering system is provided which accommodates adjustment of the lateral members relative to the back.

While in accordance with the patent statutes the best mode and preferred embodiment have been set forth, the scope of the invention is not limited thereto, but rather by the scope of the attached claims.

What is claimed is:

1. A back assembly for a wheelchair to be mounted from a pair of spaced vertical posts of the wheelchair comprising:

a back member having a longitudinal axis adapted to correspond to the direction of a user's spine and mounting hardware for fixing said back member to said pair of vertical posts, said back member comprising a first lateral side and a second lateral side, and said mounting hardware comprising at least a first mounting assembly extending from said first lateral side and including:

an attachment member for attachment to one of said vertical posts which can be independently selectively adjustably locked in a variable position along a first axis which extends transverse to the longitudinal axis of the back member and which is parallel to the plane defined by the pair of spaced vertical posts to accommodate a variety of spacings between the vertical posts;

a link connecting said attachment member to said back member having a tilt lock to independently change the relative angle between the back member and the attachment member; and a seat depth lock to independently adjust the distance which the attachment member is offset from a plane generally defined by said back member.

2. A back assembly as set forth in claim 1, wherein said back member comprises at least one rigid shell covered by foam.

3. A back assembly as set forth in claim 2, wherein said back member includes a first slot in said first lateral side and a second slot in said second lateral side and a first lateral support is joined to said back member by a pin which extends through said first slot and a second lateral support is joined to said back member by a pin which extends through said second slot.

4. A back assembly as set forth in claim 2, wherein said back member comprises multiple rigid shells covered by a foam.

5. A back assembly as set forth in claim 4, wherein said back member comprises a thoracic support having a locking adjustable hinged connection to a lumbar sacral support.

6. A back assembly as set forth in claim 5, further comprising at least one shoulder support.

7. A back assembly as set forth in claim 6, further comprising a head support.

8. A back assembly as set forth in claim 1 further comprising a first lateral support on said first lateral side and a second lateral support on said second lateral side wherein said first and second lateral supports can be independently positioned at varying widths from said longitudinal axis.

9. A back assembly as set forth in claim 8, wherein said back member is covered by foam and said lateral supports include foam scarfed so as to permit adjustability of the supports relative to the back.

10. A back assembly as set forth in claim 8, wherein said first and second support can be independently positioned at varying angles relative to said longitudinal axis.

11. A back assembly as set forth in claim 3, wherein each of said pins has a cross-section diameter and the width of said slot is greater than said cross-section diameter.

12. A back assembly for a wheelchair to be mounted from a spaced pair of vertical posts of the wheelchair comprising:

a back member and mounting hardware for fixing said back member to said spaced pair of vertical posts, said back member comprising an independent rigid thoracic support having a hinged connection to an independent rigid lumbar sacral support whereby said thoracic support can dynamically flex relative to said lumbar support in response to loading during use.

13. A back assembly as set forth in claim 12 wherein said hinged connection is a locking adjustable hinged connection which permits selective locked adjustment of the relative position of the thoracic support and the lumbar sacral support.

14. A back assembly as set forth in claim 13 wherein said hinged connection is achieved with a hinge assembly including resilient disc spacers.

15. A back assembly as set forth in claim 12 wherein said thoracic support includes a hand hold opening.

16. A back assembly as set forth in claim 12 herein said thoracic support and said lumbar sacral support are covered by a compressible foam and outer covering.

17. A back assembly as set forth in claim 16 further comprising a first and second lateral support which are selectively adjustably connected to the thoracic support and wherein said first lateral support, said second lateral support, and said thoracic support, are covered by a compressible foam.

18. A back assembly for a wheelchair to be mounted from a spaced pair of vertical posts of the wheelchair comprising:

a back member and mounting hardware for fixing said back member to said spaced pair of vertical posts, said back member comprising an independent rigid thoracic support having a locking adjustable hinged connection to an independent rigid lumbar sacral support.

19. A back assembly as set forth in claim 18 wherein said hinged connection is achieved with a hinge assembly including resilient disc spacers.

20. A back assembly as set forth in claim 18 further comprising a first and second lateral support which are selectively adjustably connected to the thoracic support.

21. A back assembly for a wheelchair to be mounted from a spaced pair of vertical posts of the wheelchair comprising:

a back member and mounting hardware for fixing said back member to said spaced pair of vertical posts, said back member comprising a first lateral side and a second lateral side, and said back member includes a first slot in said first lateral side and a second slot in said second lateral side and a first lateral support is joined to said back member by a pin which extends through said first slot and a second lateral support is joined to said back member by a pin which extends through said second slot, wherein each of said first and second pins respectively has a cross-section diameter and the width of said first and second slots is greater than said corresponding cross-section diameter. and wherein said first lateral support, said second lateral support, and said thoracic support, are covered by a compressible foam.

22. A back assembly as set forth in claim 21, wherein said back member is covered by foam, and said lateral supports include foam which is scarfed so as to permit adjustability of the supports relative to the back member.

23. A back assembly as set forth in claim 1 further comprising a second mounting assembly which can be adjusted independently of the first mounting assembly and which extends from said second lateral side and is connected to the other of said vertical posts.

* * * * *